United States Patent [19]

Prout et al.

[11] Patent Number: 4,992,018

[45] Date of Patent: Feb. 12, 1991

[54] REFUSE CONTAINER FOR USE WITH EMPTYING MECHANISM

[75] Inventors: John T. Prout, Winston-Salem; Billy R. Cagle, Statesville, both of N.C.

[73] Assignee: Toter, Inc., Statesville, N.C.

[21] Appl. No.: 336,253

[22] Filed: Apr. 11, 1989

[51] Int. Cl.[5] ..... B65F 3/02

[52] U.S. Cl. ..... 414/408; 414/409; 414/421; 414/422; 220/908; 294/90

[58] Field of Search ..... 414/403, 404, 405, 406, 414/407, 408, 409, 410, 419, 420, 421, 422, 423, 424, 425; 220/1 T; 294/90

[56] References Cited

U.S. PATENT DOCUMENTS

| | | | |
|---|---|---|---|
| 2,115,015 | 4/1938 | Eckert | 294/90 X |
| 3,112,835 | 12/1963 | Gierhart | 294/90 X |
| 3,516,562 | 6/1970 | Knight | 214/302 |
| 3,804,277 | 4/1974 | Brown et al. | 214/302 |
| 3,923,174 | 12/1975 | Stragier | 414/409 X |
| 4,005,791 | 2/1977 | Stragier et al. | 214/302 |
| 4,029,230 | 6/1977 | Bolduc et al. | 294/90 X |
| 4,128,182 | 12/1978 | Pickrell | 214/302 |
| 4,219,298 | 8/1980 | Stragier et al. | 414/409 |
| 4,461,608 | 7/1984 | Boda | 414/408 |
| 4,566,840 | 1/1986 | Smith | 414/408 |
| 4,765,503 | 8/1988 | Otto et al. | 220/1 T X |

FOREIGN PATENT DOCUMENTS

| | | | |
|---|---|---|---|
| 634432 | 1/1962 | Canada | 414/422 |
| 845512 | 6/1970 | Canada | 414/420 |
| 474111 | 10/1937 | United Kingdom . | |
| 514423 | 11/1939 | United Kingdom . | |
| 621918 | 4/1949 | United Kingdom . | |
| 633603 | 12/1949 | United Kingdom . | |
| 633604 | 12/1949 | United Kingdom . | |
| 754549 | 8/1956 | United Kingdom . | |
| 1136893 | 12/1968 | United Kingdom . | |
| 1155701 | 6/1969 | United Kingdom . | |

*Primary Examiner*—Frank E. Werner

*Attorney, Agent, or Firm*—W. Thad Adams, III

[57] ABSTRACT

A refuse container of the type adapted to be lifted during an emptying cycle from an upright position by opposed retaining arms of a mechanical dumping unit, emptied into a refuse vehicle and lowered back to the upright position. The refuse container comprises a bottom, with side walls connected to the bottom on one end and defining an open top on the other end. The side walls include first and second spaced-apart shoulders which define a narrowed waist formed in the walls around the periphery of the refuse container to receive the retaining arms and lock the refuse container against movement relative to the retaining arms during both the lifting and lowering movements of the emptying cycle.

14 Claims, 4 Drawing Sheets

REFUSE CONTAINER FOR USE WITH EMPTYING MECHANISM

TECHNICAL FIELD AND BACKGROUND OF THE INVENTION

This invention relates to a refuse container for use with an emptying mechanism. Emptying mechanisms are now in common use on refuse collection trucks. They enable very large refuse containers to be quickly and completely emptied without risk of injury to sanitation workers due to strain. Use of large refuse containers enables homeowners to place trash and garbage in the container during the week and then roll the container to streetside for collection once or twice a week. Therefore, sanitation workers do not need to go from back yard to back yard emptying a wide variety of garbage cans into a carryable or rollable container for delivery to the collection truck at streetside.

Rectangular refuse containers are generally emptied with a lifting mechanism by which the container is hooked and the container is inverted. Such a device is exemplified in U.S. Pat. No. 3,804,277, owned by applicant.

Cylindrical refuse containers are emptied using a mechanism which grips or clamps the side walls of the container with sufficient force to prevent slippage as the container is lifted, emptied and then lowered. Such units are shown in, for example, U.S. Pat. Nos. 3,516,562, 4,128,182, and 4,461,608.

The present invention relates to a refuse container of a type particularly designed to be lifted by a mechanical emptying unit in such a way that the container is "locked" into position and not held merely by friction.

SUMMARY OF THE INVENTION

Therefore, it is an object of the invention to provide a refuse container for use with a mechanical refuse container emptying unit.

It is another object of the invention to provide a refuse container which is held by a secure mechanical connection between the container and the lifting unit.

It is another object of the invention to provide a refuse container which is positively held during a lifting and a lowering emptying motion.

It is yet another object of the present invention to provide a refuse container which can be lifted and lowered without a "clamping" movement which must deform the container in order to securely hold it.

These and other objects of the present invention are achieved in the preferred embodiments disclosed below by providing a refuse container of the type adapted to be lifted during an emptying cycle from an upright position by opposed retaining arms of a mechanical dumping unit, emptied into a refuse vehicle and lowered back to the upright position. The refuse container comprises a bottom, with side walls connected to the bottom on one end and defining an open top on the other end. The side walls include first and second spaced-apart shoulders which define a narrowed waist formed in the walls around the periphery of the refuse container to receive the retaining arms and lock the refuse container against movement relative to the retaining arms during both the lifting and lowering movements of the emptying cycle.

According to one preferred embodiment of the invention, the first shoulder is positioned adjacent the open top and the second shoulder is positioned adjacent the bottom, and wherein the first shoulder is deeper than the second shoulder.

According to another preferred embodiment of the invention, the refuse container is circular in horizontal cross-section.

According to yet another preferred embodiment of the invention, the refuse container is frusto-conical in shape.

Preferably, the mouth of the refuse container is larger than the bottom.

Preferably, the refuse container includes at least one pair of wheels mounted adjacent the bottom for rolling the container and includes a covering lid.

According to one preferred embodiment of the invention, the first shoulder includes a chamfered edge and the width of the waist is less than twice the corresponding width of the retaining arms.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
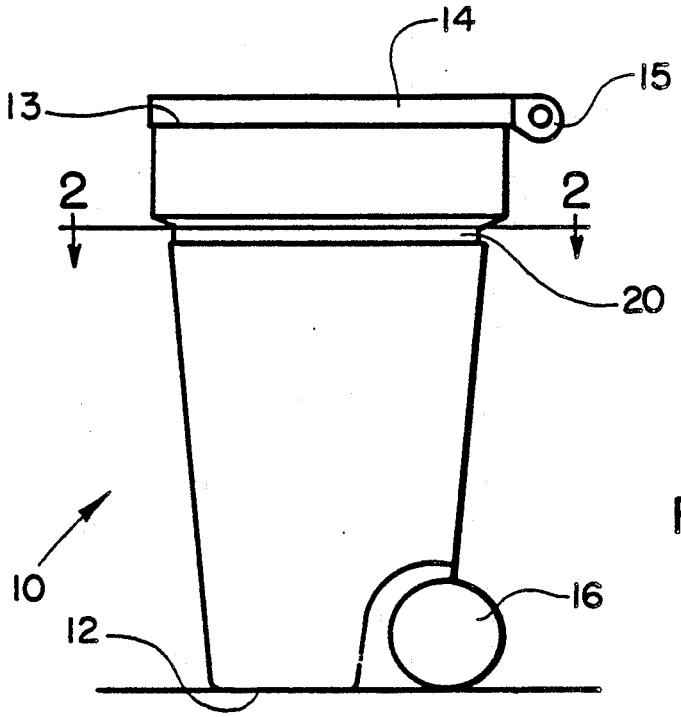
FIG. 1 is side elevation view of a refuse container according to the present invention.

Referring now specifically to the drawings, a refuse container according to the present invention is illustrated in FIG. 1 and shown generally at reference numeral 10. Container 10 preferably comprises a molded plastic body having a bottom 12 and a mouth 13 covered by a lid 14. A handle 15 enables the container 10 to be pushed along o rolling wheels 16.

Figure 4:
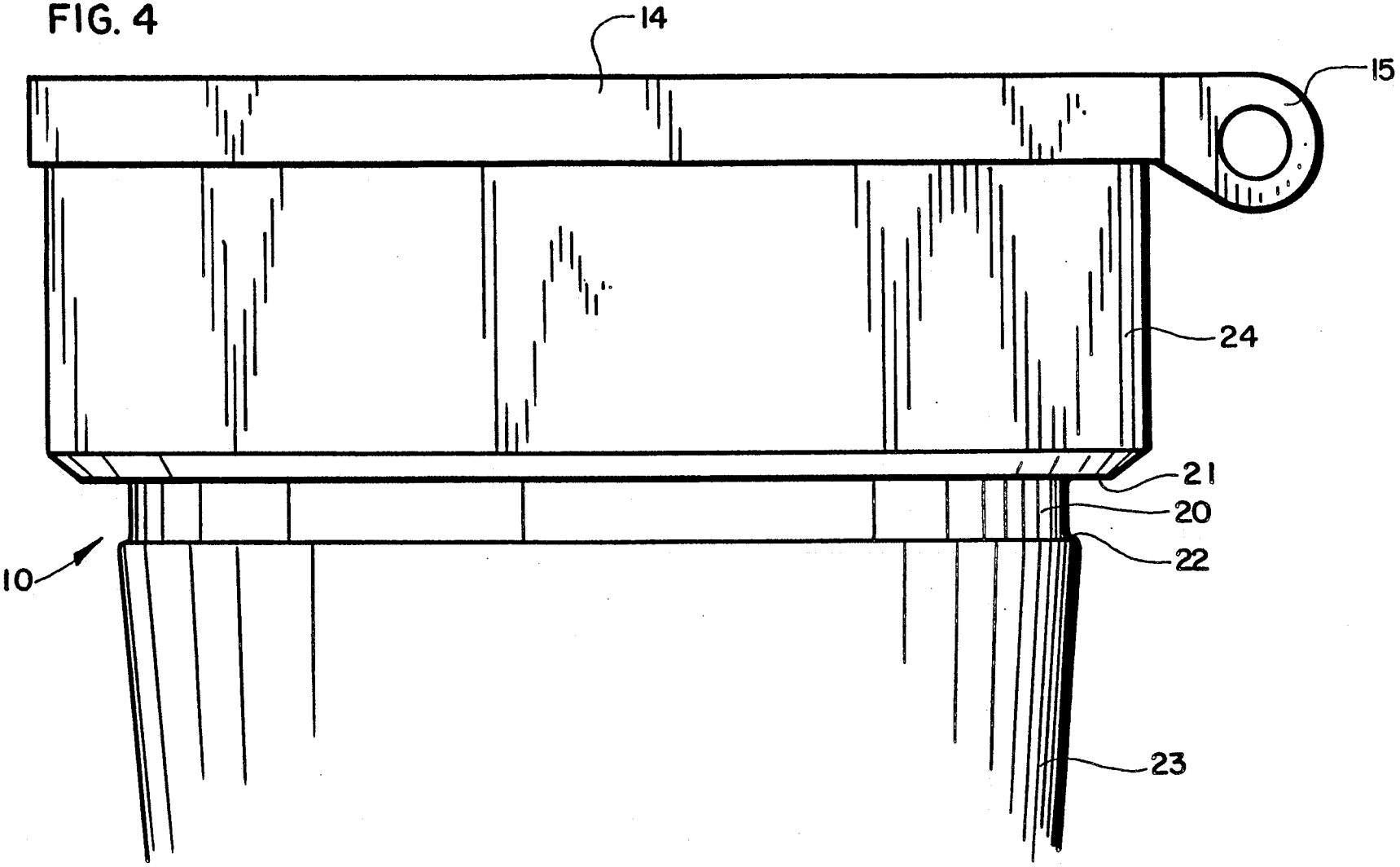
FIG. 4 is an enlarged fragmentary view of the upper portion of the refuse container shown in FIGS. 1, 2 and 3.

In accordance with the present invention, an annular, narrowed waist 20 is molded into the side walls of container 10 near the upper end of the container 10. As is best shown in FIG. 4, the molded waist 20 is defined by a first, upper shoulder 21 and a second, lower shoulder 22. In the particular embodiment shown in the Figures, the upper shoulder 21 is larger and defines an enlarged upper container segment 24.

The lower shoulder 22 defines the upper terminus of a lower container segment 23.

The volume of the container can be varied by varying the depth of the segment 24. The enlarged size of the upper container segment 24 enables the volume of the container 10 to be increased by an amount greater than the percentage increase in the height of the container 10 occasioned by increasing the depth of the upper container segment 24.

Figure 2:
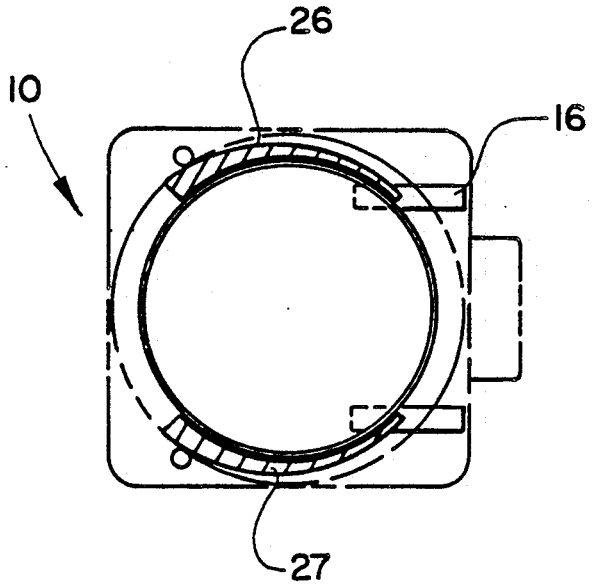
FIG. 2 is a top plan view of the refuse container shown in FIG. 1.

Referring now to FIG. 2, the placement of curved retaining arms 26 and 27 such as carried on the rear of a refuse truck around the container can be seen. The provision of the waist 20 facilitates the operation of the arms 26 and 27 by permitting them to slide upwardly along the side of the container 10 until the waist 20 is reached.

Figure 3:
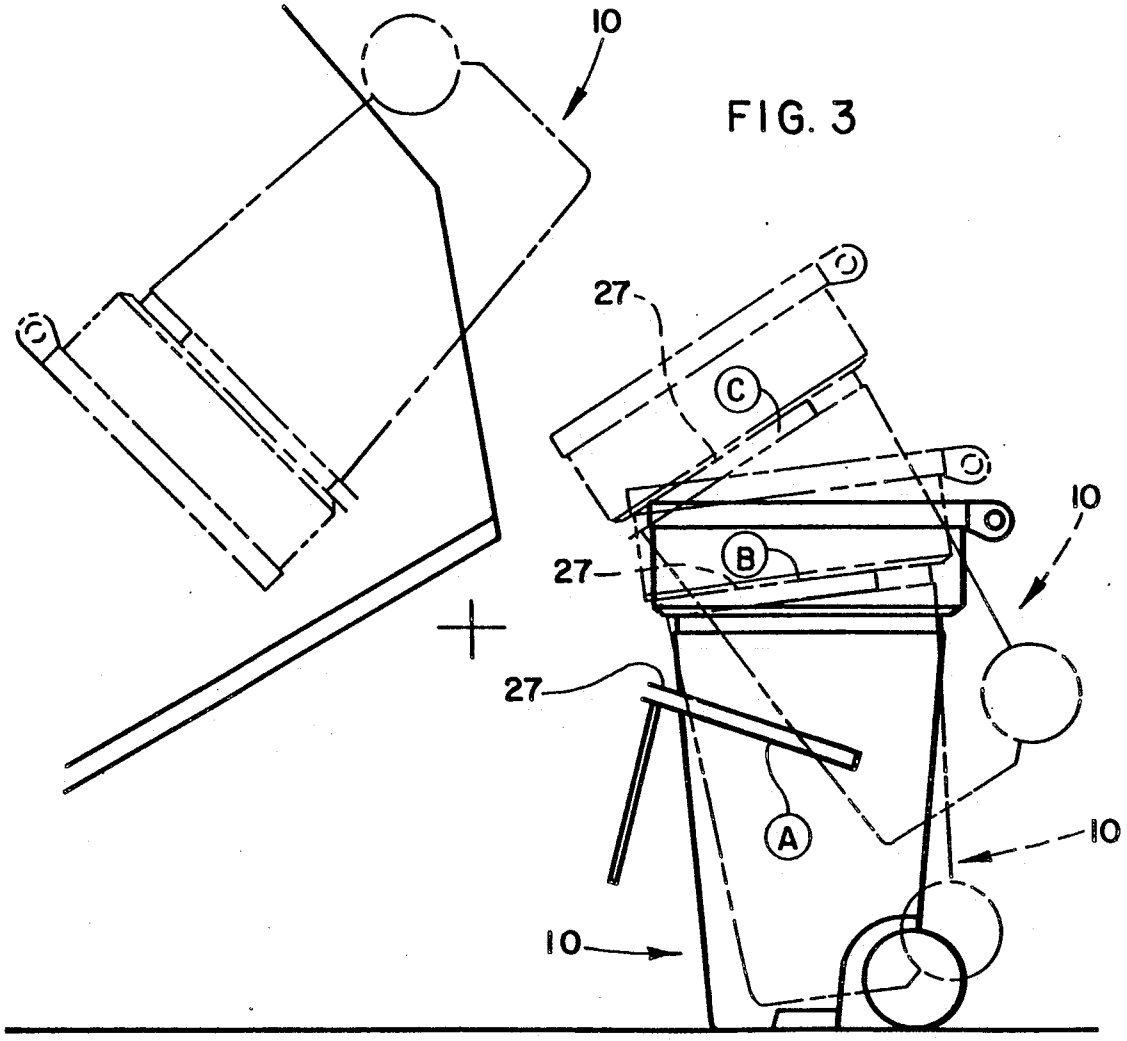
FIG. 3 is a sequential view of the lifting operation with the refuse container shown in FIGS. 1 and 2.

As is shown in FIG. 3, arms 26 and 27 are in an open position loosely around container 10 at position "A." As arms 26 and 27 move upwardly, they catch on the upper shoulder 21 and begin lifting container 10, as is shown at position "B". As lifting continues, the arms move further inwardly into the waist 20 so that they loosely grasp container 10, as is shown at position "C." At no time do the arms 26 and 27 so tightly grasp container 10 so as to deform it.

Figure 5:
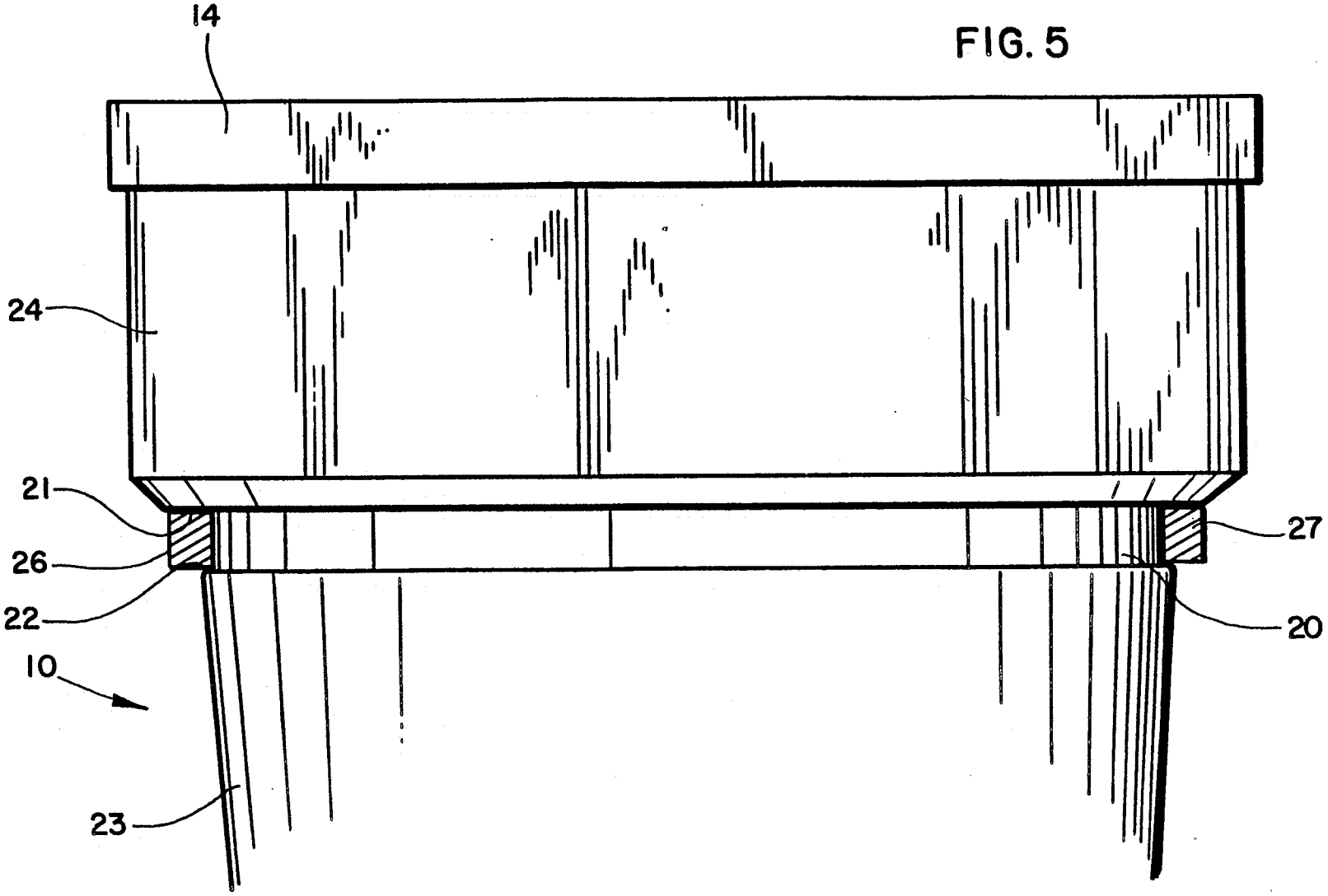
FIG. 5 is a cross-sectional view showing the relationship of the arms to the waist.

The provision of the upper and lower shoulders 21 and 22 provide a positive lock so that the container 10 cannot slide out of the grasp of arms 26 and 27 even at the positions shown in FIG. 3 where container 10 is well past the horizontal. See FIG. 5. As is shown at position "D" of FIG. 3, shoulder 22 prevents container 10 from falling forward away from the grip of arms 26 and 27. A variety of constructions of container 10 are possible. For example, the lower container segment 23 can be smaller than upper container segment 24, as is shown in the drawings. The lower container segment 23 can be annular in cross section, and cylindrical or frusto-conical in shape, while the upper container segment can be the same or another other size and shape, such as square or rectangular. The waist 20 provides a transition between these varying shapes. Waist 20 itself can be either annular, as is shown in the drawings, or some other shape as is necessary or desirable to achieve some particular objective.

A refuse container is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

I claim:

1. A refuse container of the type adapted to be lifted during an emptying cycle from an upright position by opposed retaining arms of a mechanical dumping unit, tiltably emptied into a refuse vehicle and lowered back to the upright position, said refuse container being molded of plastic and comprising a bottom, side walls connected to said bottom on one end and defining a substantially open top on the other end thereof, said side walls including a first wall segment and a second wall segment spaced-apart from said first wall segment and defining in the space between said first and second wall segments a narrowed waist formed in the walls around the periphery of the refuse container, said waist having a height dimension adapted to receive retaining arms having substantially the same height dimension as the waist and to receive the retaining arms and lock the refuse container against substantial vertical and horizontal movement relative to the retaining arms during both the lifting and lowering movements of the emptying cycle without clamping pressure against the side walls of the container.

2. A refuse container according to claim 1, wherein said refuse container is circular in horizontal cross-section.

3. A refuse container according to claim 1, wherein said refuse container is frusto-conical in shape.

4. A refuse container according to claim 1, wherein the mouth of said refuse container is larger than the bottom.

5. A refuse container according to claim 1, wherein said refuse container includes at least one pair of wheels mounted adjacent the bottom for rolling the container.

6. A refuse container according to claim 1, wherein said refuse container includes a covering lid.

7. A refuse container according to claim 1, wherein the width of said waist is less than twice the corresponding width of the retaining arms.

8. A refuse container according to claim 1, wherein said container is molded polymer.

9. A refuse container of the type adapted to be lifted during an emptying cycle from an upright position by opposed retaining arms of a mechanical dumping unit, tiltably emptied into a refuse vehicle and lowered back to the upright position, said refuse container being molded of plastic and comprising a bottom, annular, tapered side walls connected to said predetermined small size bottom on one end and defining a relatively larger diameter substantially open top on the other end thereof, said side walls including first and second spaced-apart wall segments defining a narrowed annular waist formed in the in the space between said first and second wall segments around the periphery of the refuse container, said waist having a height dimension adapted to receive retaining arms having substantially the same height dimension as the waist and to receive the retaining arms and lock the refuse container against substantial vertical and horizontal movement relative to the retaining arms during both the lifting and lowering movements of the emptying cycle without clamping pressure against the side walls of the container.

10. A refuse container according to claim 9, wherein said refuse container is frusto-conical in shape.

11. A refuse container according to claim 9, wherein said refuse container includes at least one pair of wheels mounted adjacent the bottom for rolling the container.

12. A refuse container according to claim 9, wherein said refuse container includes a covering lid.

13. A refuse container according to claim 9, wherein the width of said waist is less than twice the corresponding width of the retaining arms.

14. A refuse container according to claim 9, wherein said container is molded polymer.

* * * * *